US007490948B2

(12) United States Patent
Fisherman et al.

(10) Patent No.: US 7,490,948 B2
(45) Date of Patent: Feb. 17, 2009

(54) MULTIFUNCTION READING LIGHT AND BOOK COVERS THEREFORE

(75) Inventors: Eric Fisherman, Upper Saddle River, NJ (US); Wai Hong Chan, Hong Kong (CN); Sze Man Cheung, Hong Kong (CN)

(73) Assignee: Eric Fisherman, Inc., Ridgewood, NJ (US)

( * ) Notice: Subject to any disclaimer, the term of this patent is extended or adjusted under 35 U.S.C. 154(b) by 0 days.

(21) Appl. No.: 11/468,509

(22) Filed: Aug. 30, 2006

(65) Prior Publication Data

US 2008/0049416 A1 Feb. 28, 2008

Related U.S. Application Data

(60) Provisional application No. 60/823,407, filed on Aug. 24, 2006.

(51) Int. Cl.
*A47B 19/00* (2006.01)

(52) U.S. Cl. ..... 362/98; 362/99

(58) Field of Classification Search ..... 362/98–99
See application file for complete search history.

(56) References Cited

U.S. PATENT DOCUMENTS 3,823,312 A * 7/1974 Weinstein ..... 362/99
4,581,684 A * 4/1986 Mazzucco ..... 362/98
2003/0012013 A1* 1/2003 Herrera ..... 362/99
2003/0133304 A1* 7/2003 Wallach ..... 362/414

* cited by examiner

*Primary Examiner*—Anabel M Ton
*Assistant Examiner*—Julie A Shallenberger
(74) *Attorney, Agent, or Firm*—William J. Sapone; Coleman Sudol Sapone P.C.

(57) ABSTRACT

The present invention is an improved book cover and removable reading light, the book cover having a central spine section having a longitudinal pocket therein and two outer covers each pivotally connected to opposite edges of the central spine section. An elongated reading light is removably mounted in the pocket of the central spine section, the reading light having a housing including a battery compartment for receiving batteries and a second compartment for receiving an extendable supporting arm for the reading light. The supporting arm and reading light are disposed for movement relative to the second compartment between an open position in which the supporting arm extends out of the second compartment and a closed position in which the supporting arm is disposed within the second compartment. In addition, the reading light is movably mounted relative to the supporting arm for directing light in different directions, as desired by the user. The housing additionally includes a locking device that engages the central spine for locking the light in position when used with the book cover. The locking device enables the reading light to be removed and used with a different size or shape book cover, or with an accessory holder for performing other functions such as mounting in a writing folder, on a music stand or on a computer monitor, so a single reading light can perform multiple functions.

10 Claims, 8 Drawing Sheets

MULTIFUNCTION READING LIGHT AND BOOK COVERS THEREFORE

CROSS REFERENCE TO RELATED APPLICATIONS

This application claims priority in U.S. Provisional patent application No. 60/823,407 filed on Aug. 24, 2006.

TECHNICAL FIELD

This invention relates to a book cover and integral reading light and, more particularly, to use of a removable reading light which can be used with various shape and size book covers as well as with other accessories to provide multiple functions for the user.

BACKGROUND

The use of a reading light with a book cover is known. In U.S. Pat. No. 3,364,344, a reading light and batteries are housed separately and incorporated with the book cover. In U.S. Pat. Nos. 1,202,498 and 3,823,312, a container is mounted on the spine of a book cover to house the batteries for a reading light. However, in such arrangements, the reading light is disposed outside of the battery container and cannot be stored when not in use.

In U.S. Pat. No. 4,680,681, commonly assigned with the invention herein, an improved combination of a book cover and reading light is described, which overcame the drawbacks of the prior art. Specifically, this patent describes an improved integral reading light and book cover which is simple to use, the light being easy to store, inexpensive, convenient, compact, and portable, and which accommodates all types of books, including paperbacks and hard cover books, as well as books of different sizes and thicknesses.

The book cover has a central spine section, and two outer covers, each pivotally connected to opposite edges of the central spine section. An elongated housing is mounted on the central spine section, having one compartment for receiving batteries and a storage compartment for receiving a supporting arm for the reading light. The supporting arm can move between an open position in which the supporting arm extends for illuminating a book, and a closed position in which said supporting arm is stored within the storage compartment. The reading light is movable for directing light in different directions.

While an attempt was made to adapt the integral light and cover for use with different sized books, by using scoring or corrugations to allow the book cover to fold more easily and accommodate books of different thicknesses, this has proved only marginally successful.

SUMMARY OF THE INVENTION

It is an object of the present invention to overcome the problems associated with the prior integral book cover and reading light, and to adapt the light for more uses.

It is a particular object to provide a book cover and reading light, where the light can be removed and used with different covers or with other accessory housings for performing multiple functions.

These and other objects of the present invention are achieved by an improved book cover and removable reading light, the book cover having a central spine section having a longitudinal pocket therein and two outer covers each pivotally connected to opposite edges of the central spine section.

An elongated reading light is removably mounted in the pocket of the central spine section, the reading light having a housing including a battery compartment for receiving batteries and a second compartment for receiving an extendable supporting arm for the reading light. The supporting arm and reading light are disposed for movement relative to the second compartment between an open position in which the supporting arm extends out of the second compartment and a closed position in which the supporting arm is disposed within the second compartment. In addition, the reading light is movably mounted relative to the supporting arm for directing light in different directions, as desired by the user. The housing additionally includes a locking device that engages the central spine for locking the light in position when used with the book cover. The locking device enables the reading light to be removed and used with a different size or shape book cover, or with an accessory holder for performing other functions as will be discussed more fully below.

DETAILED DESCRIPTION OF THE PREFERRED EMBODIMENTS

Figure 1:
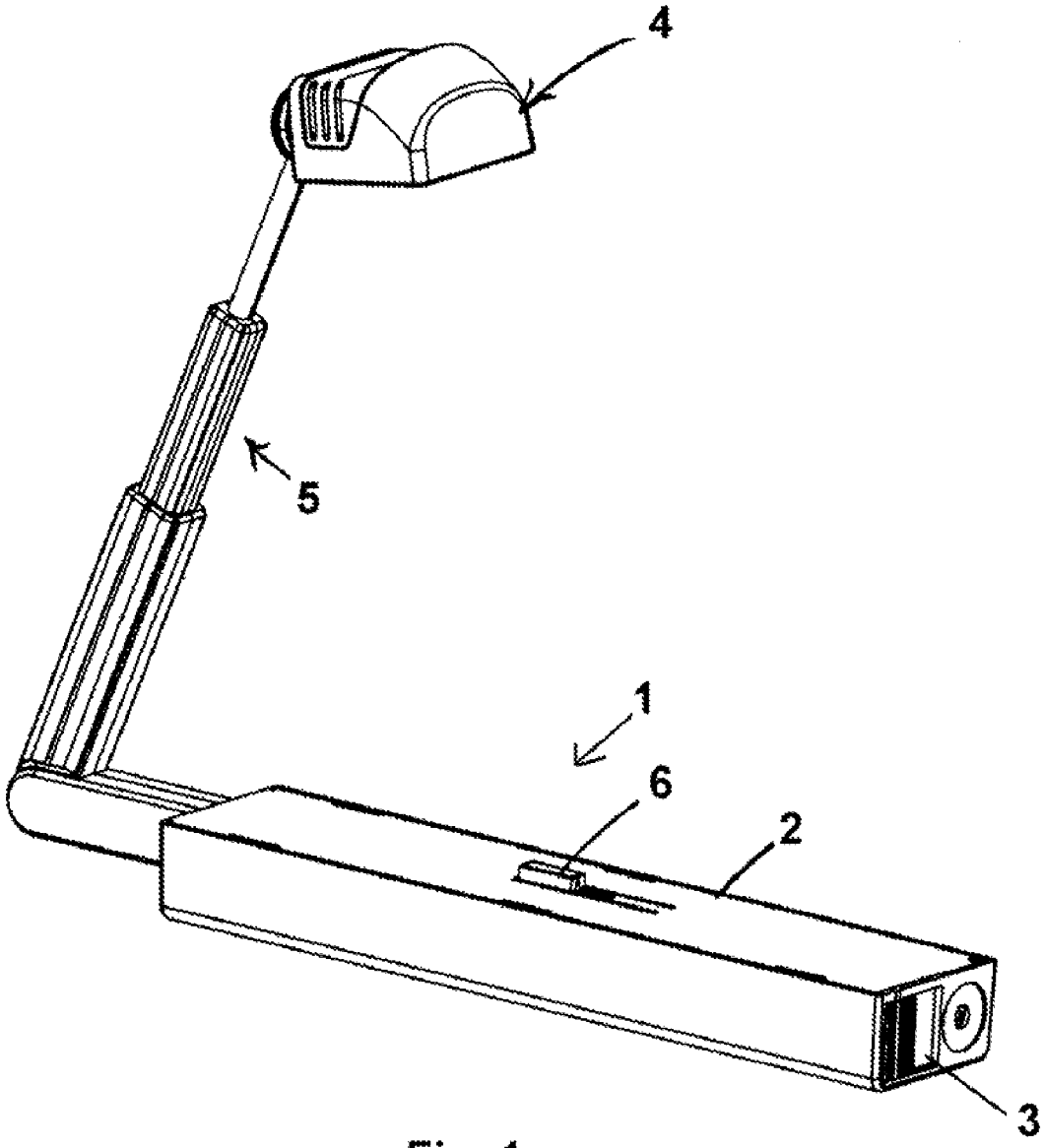
FIG. 1 is a perspective view of the multifunction reading light illustrating the reading light and supporting arm in its extended position.

Referring to FIG. 1, a removable reading light 1 is shown. The reading light has a casing 2, with a battery compartment (not shown), accessed via a removable panel 3. The light itself 4 is mounted at the end of an arm 5 that extends from the casing 2, the arm having telescopic sections that enable extension and retraction of the light 4 from a storage compartment located in the casing 2. The arm is fully articulatable into many different settings, for directing light to a surface for illumination, as would be well understood by one skilled in the art.

The removable reading light further has a locking device 6, which is a button, tab or detent that is displaceable inwardly, being biased in an outward position, as shown in FIG. 1.

Figure 2:
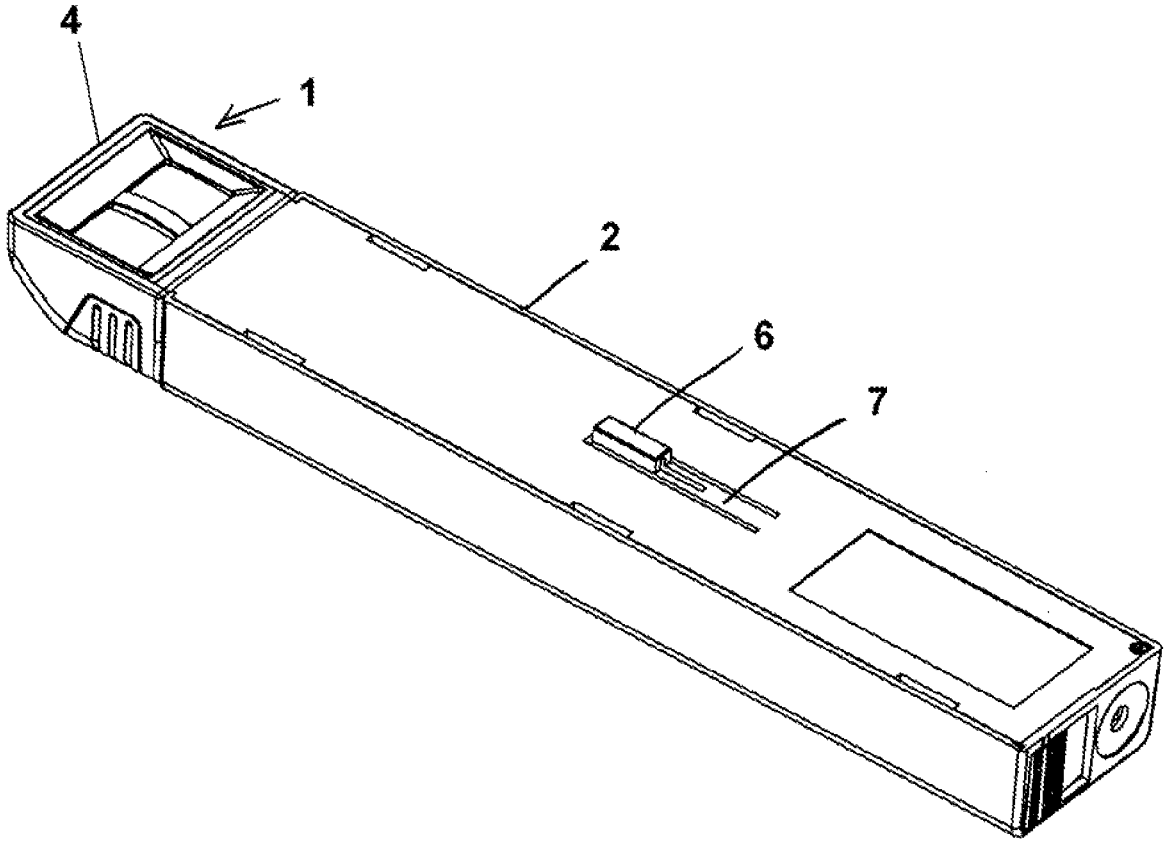
FIG. 2 is a perspective view illustrating the supporting arm when in its retracted or closed position with the reflector housing closing off the upper end of the battery housing.
Figure 3:
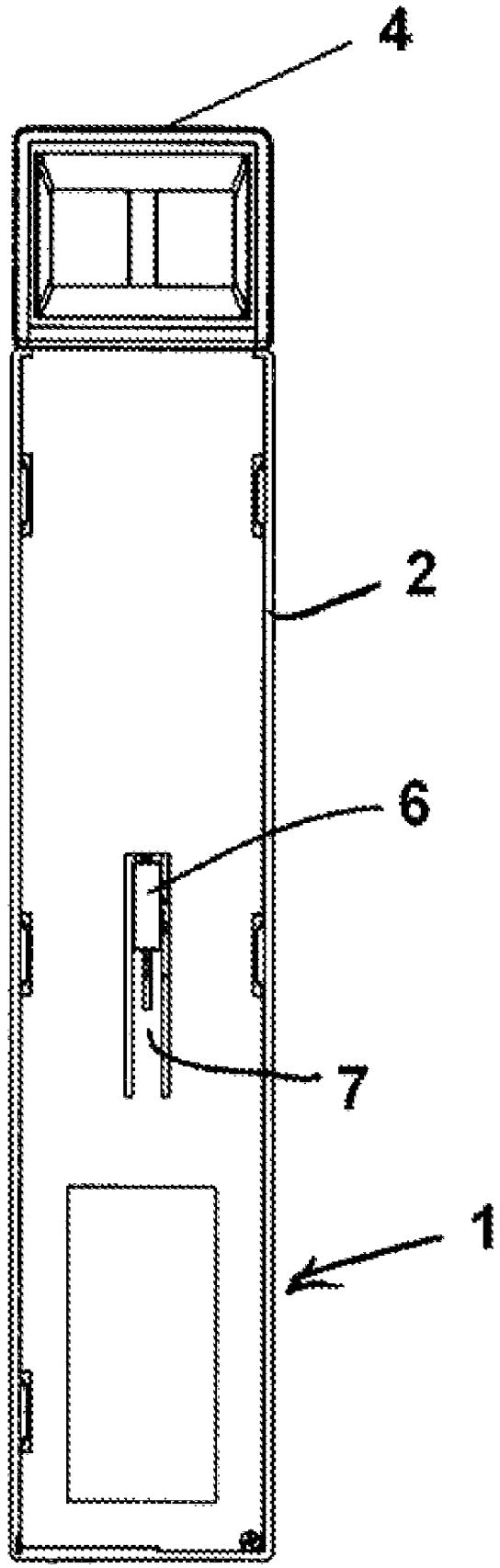
FIG. 3 is a plan view of the removable reading light, with the reading light in the stored position, prior to mounting in a holder.

Referring to FIG. 2, the light and arm are in the stowed position, providing a fairly compact unit. This figure better illustrates that the detent 6 is mounted on a cantilevered arm 7 that is flexible inwardly for displacing the detent inwardly with light finger pressure. Of course, other means for biasing the detent into an upper position are possible, and the invention is not limited to this particular structure. Similarly, other means for removably locking the removable reading light in position may also be used. FIG. 3 shows the reading light in a plan view, prior to incorporation with a book cover, with the light and arm in the stowed position.

Figure 4:
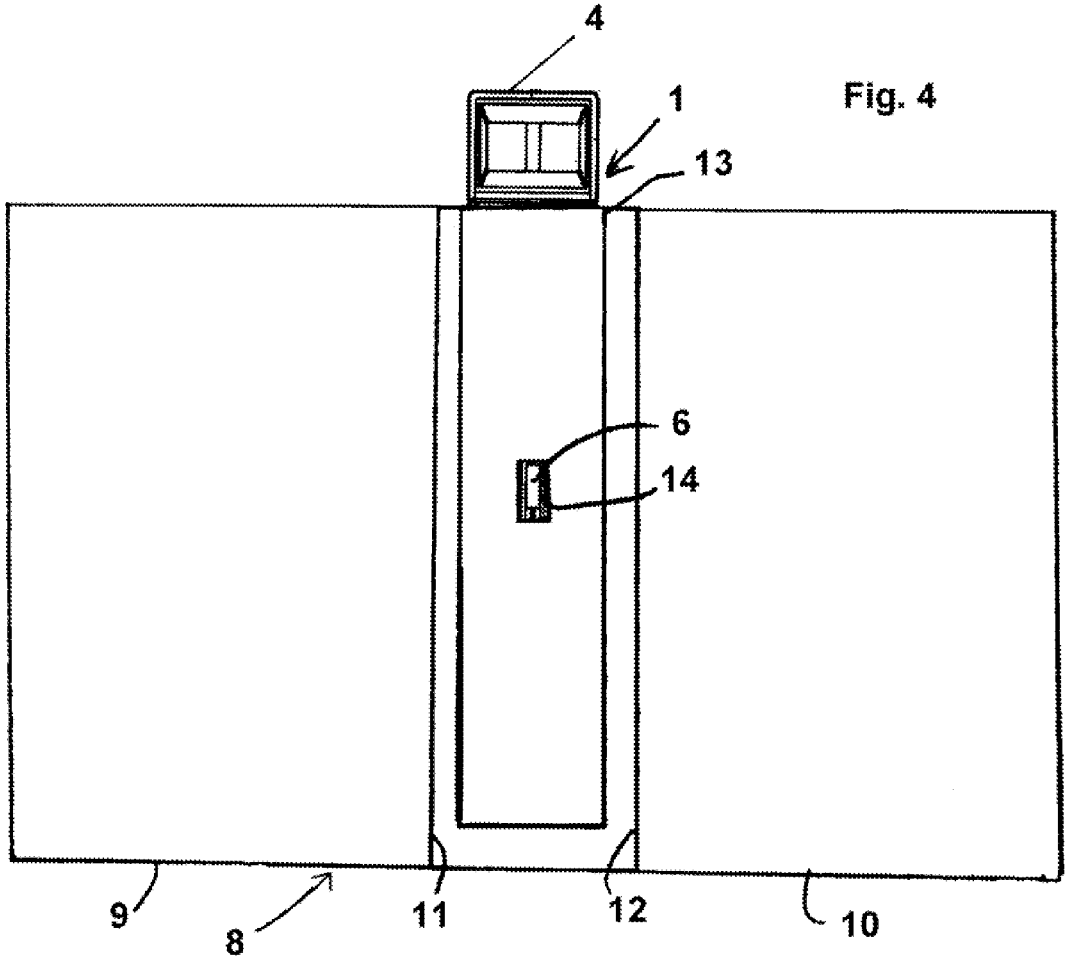
FIG. 4 is a plan view of the removable reading light mounted in a book cover.

Referring to FIG. 4, the removable reading light 1 is shown incorporated with a book cover 8 having a pair of end flaps 9 and 10, having inner pockets 11 and 12 for receiving the covers of a book therein, thereby mounting the book for illuminated reading.

The reading light is incorporated by sliding the reading light slid into a pocket or chamber 13 arranged along a spine of the book cover, with the detent pressed inwardly as the detent engages an upper wall of the pocket. The light continues to move into the pocket until the detent 6 is aligned with an opening 14, whereupon, the detent enters the opening 14 and locks the removable reading light in position.

In accordance with the present invention, the removable reading light can be incorporated and moved between various covers and light holders containing such pockets, the light holders being either incorporated with other items, such as folders, or having means for mounting for use in many user selected locations.

Figure 5:
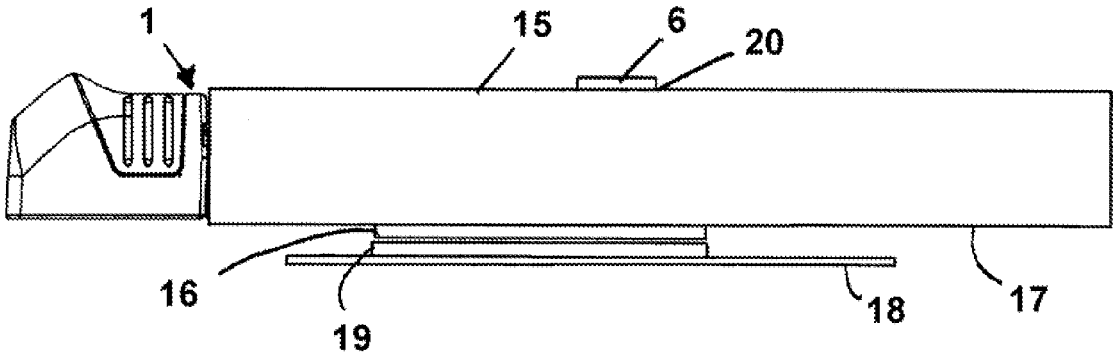
FIG. 5 is a side view showing the removable reading light mounted in a holder with a releasable fastening strip for utility mounting.

For example, in FIG. 5, the removable reading light 1 is inserted into a light holder 15 comprising a pocket that has a separable fastener 16 located on a back surface 17 thereof. This allows mounting the light holder 15 to a base 18 having a mating separable fastener 19, which can be adhesively, mechanically, magnetically, or otherwise engaged, i.e. using Velcro, a clip or double sided adhesive, for example, to various surfaces. The light holder, in essence being a sleeve-like case for the light, can then be mounted using the base on virtually any surface, such as a desk, a headboard of a bed, a music stand, a car dashboard, or on a computer monitor.

The reading light 1 is placed in the light holder pocket 15, until the locking device 6 locks into a mating receptacle 20 for holding the light in position. Then, the holder can be mated to the base 18, already mounted in the desired location, so that a single reading light can be used for many different purposes, and in other locations. For example, the base 18 can be mounted on a computer monitor, or music stand, with the light 1 removed from a book cover by pressing in the detent 6, and the light pulled from the pocket 13, and then incorporated into the light holder 15 and used, for example, to illuminate music sheets. The light can then be relocated again, either with the same light holder for placement in a different location, or removed from the light holder and put back into the same book cover, or a different cover.

Figure 6:
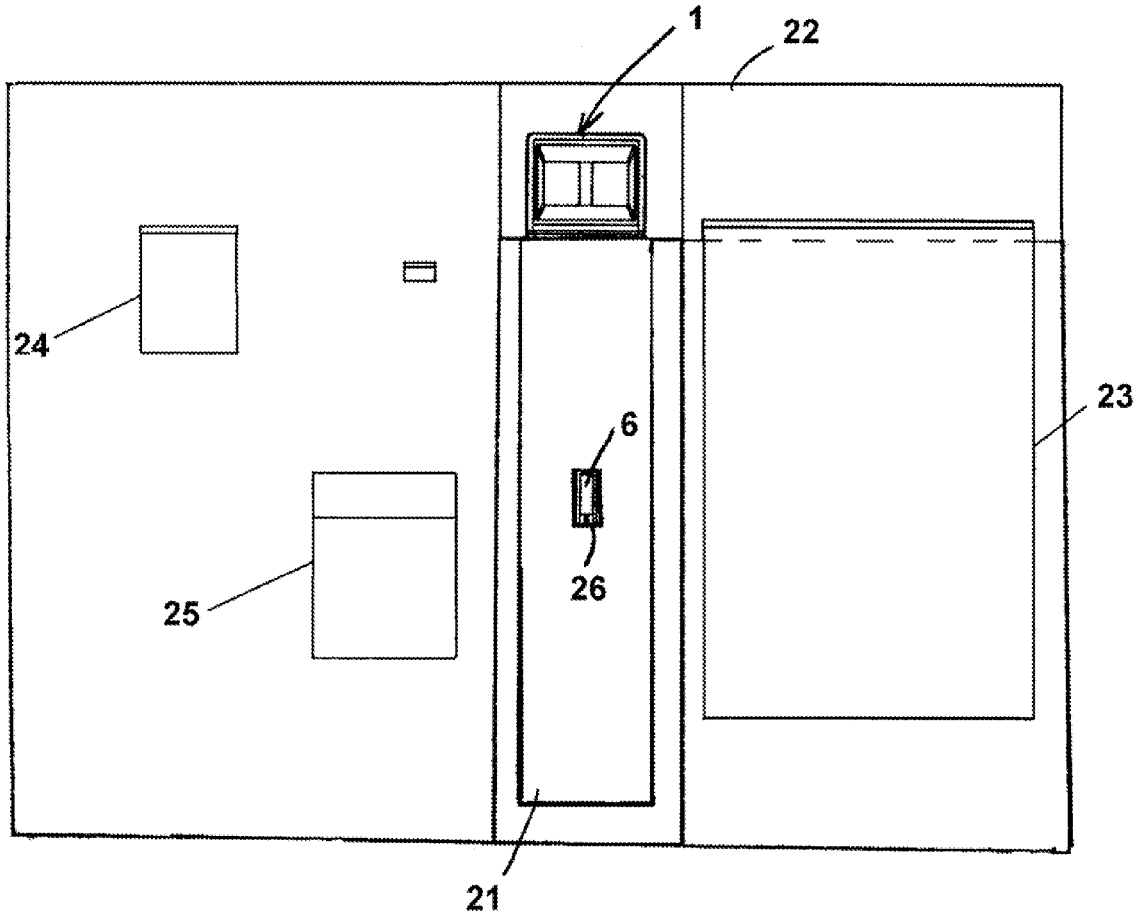
FIG. 6 is a plan view showing the reading light mounted in a holder integrated with a portfolio.

Another example is shown in FIG. 6, where a light holder pocket 21 is integrally formed in a portfolio 22 that contains a writing pad 23, and pockets 24 for papers or other items. Note that the light holder need not be located along the spine, but can be incorporated on one side or the other of the portfolio. In FIG. 6, the removable and relocatable reading light is mounted in the light holder, as in the previous embodiments, with a locking device in the form of a displaceable detent 6 mated to an opening 25 such that the detent can be pressed back through the opening for releasing the light from the light holder pocket.

Figure 7:
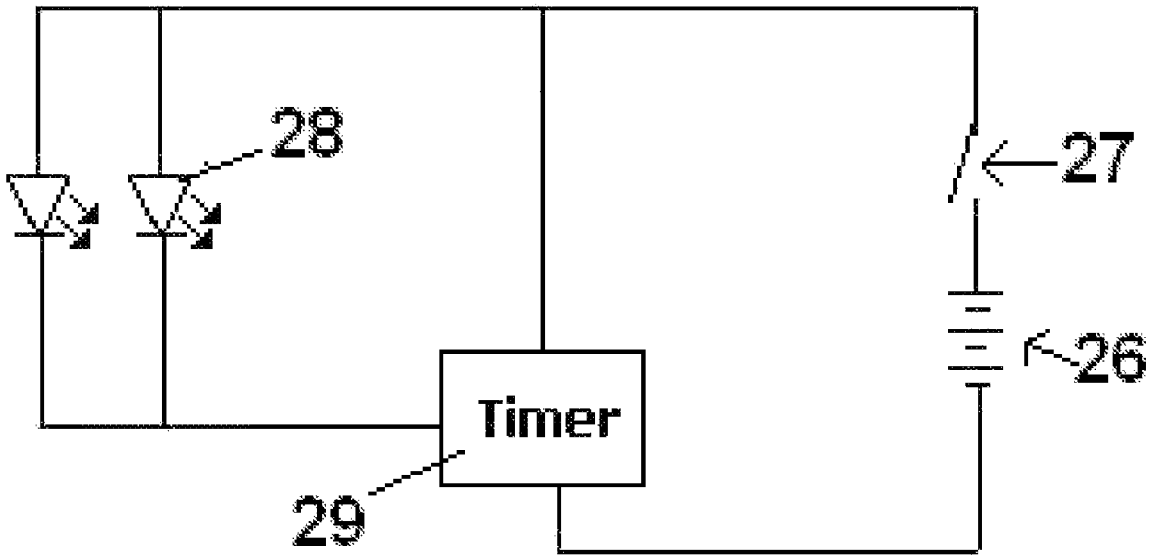
FIG. 7 is a view of an illustrative circuit diagram for use with the removable reading light of the present invention.

Referring to FIG. 7, a power circuit that may be used in the present invention is shown. This circuit has a power source 26 an on/off switch 27 for powering two lights, 28. The on/off switch would preferably be built into the light, such that extending the arm turn the light on automatically, and pushing the arm back into the storage position turns the light off. Of course, other on/off switches could be used. Optionally, the circuit may includes a timer 29, so that the light will turn off automatically after a fixed time period, such as 20, 30, or 45 minutes. This is useful for example, in case the user puts down the book and forgets to put the light away, falls asleep, etc, to preserves battery life. To turn the light on after the timer has shut it off, the user would just toggle the on/off switch, such as by pushing the arm back in and pulling it out again. This would reset the timer.

Figure 8:
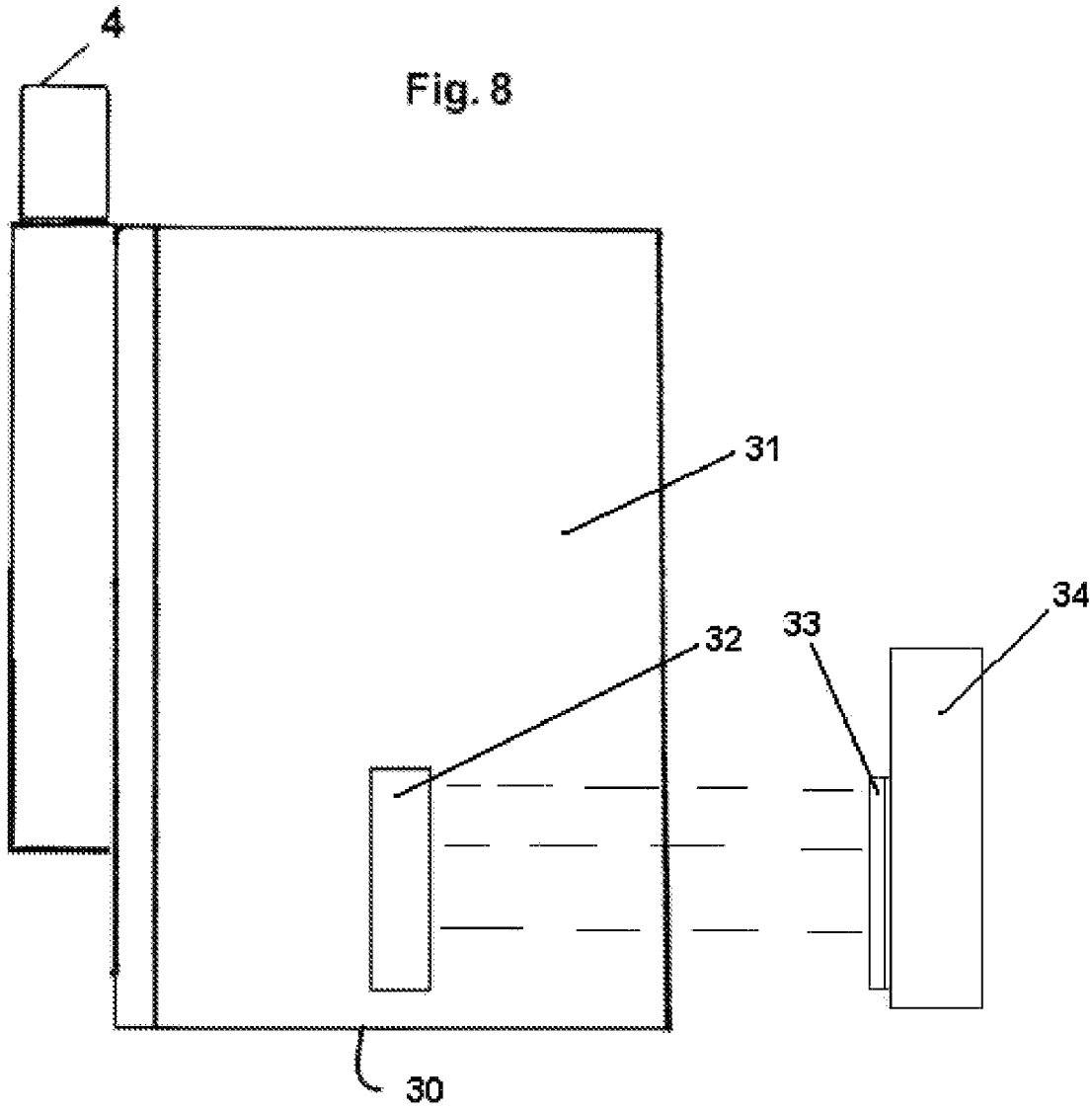
FIG. 8 is an alternative embodiment of the book cover usable with the present invention, including means for holding other devices incorporated therewith.

Another convenience feature that may be used with the inventive removable light involves an improvement to the book cover itself Referring to FIG. 8, a book cover 30 has on an outside surface 31 thereof, a part of a releasable fastener 32, such as part of a hook and loop separable fastener, as discussed above. As above, a mating strip 33 can be incorporated with other devices or holders, such as a holder for eyeglasses, for a portable digital audio players and MP3 players, (MP3 Player, IPOD, etc), for a cellular phone or for a personal digital assistant (PDA). Of course, other devices and items could be temporarily attached to the book cover, as multiple strips can be provided to the user for adhesively applying to the different devices or holders, one or more of which can be attached to the book cover as needed. This allows attaching the device or device holder to the book cover, so the device is readily accessible and at hand, should the device be needed while the user is using the book cover. This can also be used with the folder, discussed above.

Using the present invention, the same reading light can perform many functions, being mountable with book covers of different sizes and shapes, other types of covers and folders such as music folders, checkbook covers, portfolios, etc, including for example, photo albums, scrap books, etc, as well as with holders matable with separable fasteners to virtually any surface. It should also be understood that the articulated arm, and light can be provided in many different forms and configurations, being only limited to meeting the requirements for providing a directable light of sufficient brightness for illuminating a surface sufficiently to meet the requirements of the user. Incandescent, fluorescent and light emitting diodes may be used as the light source, and an auxiliary connection for obtaining hard wired power, rather that using the batteries, is an option that may be incorporated in the inventive device.

It should be understood that a single removable reading light of the present invention may be used with many different book covers for holding books of any type, including paperbacks or hard cover books, of any size and of any thickness.

While preferred embodiments of the present invention have been shown and described, it will be understood by those skilled in the art that various modifications can be made without varying from the scope of the invention. For example, various locking means other than those shown and described may be used with the present invention.

What is claimed is:

1. A book cover with a removable and relocatable reading light comprising:

a book cover having a central spine section and two outer covers each pivotally connected to opposite edges of the central spine section;

a longitudinal light holding pocket comprised of a sleeve having a shape corresponding to the shape of the elongated reading light, and having an entrance at an upper end thereof, the light holding pocket located on an exterior surface of the central spine section, the central spine section having an opening extending from the exterior surface to an interior surface of the central spine section;

a removable elongated reading light removably mounted via the entrance into the longitudinal light holding pocket for positioning the reading light on the exterior of the central spine section, the reading light comprised of a casing including a battery compartment for receiving batteries and a second compartment for receiving an extendable supporting arm for a light, the supporting arm and light being disposed for movement relative to the second compartment between an open position in which the supporting arm extends out of the second compartment and a closed position in which the supporting arm is disposed within the second compartment, the light being movably mounted relative to the supporting arm for directing light in different directions, the casing having a releasable locking device which enters the opening in said exterior surface of the central spine section for locking the removable elongated reading light in position when inserted into the longitudinal pocket, release of the locking device from the opening allowing the reading light to be removable and relocatable for use with other items having light holding pockets.

2. The book cover with a removable and relocatable reading light of claim 1 wherein the locking device is an outwardly biased detent.

3. The book cover with a removable and relocatable reading light of claim 1 further comprising a circuit located within the casing for powering the reading light, the circuit containing a timer.

4. The book cover with a removable and relocatable reading light of claim 1 further comprising a separable fastener located on an outer surface of the outer cover, a mating fastener engaged to a device or holder for mounting on the book cover.

5. The book cover with a removable and relocatable reading light of claim 4 wherein the separable fastener is selected from the group consisting of adhesives, clips, magnetic, Velcro® or other separable fasteners.

6. A folder combined with a removable and relocatable reading light comprising:

a folder having a central spine section and two outer covers each pivotally connected to opposite edges of the central spine section;

a longitudinal light holding pocket comprised of a sleeve having a shape corresponding to the shape of the elongated reading light, and having an entrance at an upper end thereof, the light holding pocket located on an exterior surface of the folder, the folder having an opening extending from the exterior surface to an interior surface of the central spine section;

an elongated reading light removably mounted via the entrance into the longitudinal light holding pocket for positioning the reading light on the exterior of the folder in correspondence with the opening, the reading light comprised of a casing including a battery compartment for receiving batteries and a second compartment for receiving an extendable supporting arm for a light, the supporting arm and light being disposed for movement relative to the second compartment between an open position in which the supporting arm extends out of the second compartment and a closed position in which the supporting arm is disposed within the second compartment, the light being movably mounted relative to the supporting arm for directing light in different directions, the casing having a releasable locking device which enters the opening in said exterior surface of the folder for locking the removable elongated reading light in position when inserted into the longitudinal pocket, release of the locking device from the opening allowing the reading light to be removable and relocatable for use with other items having light holding pockets.

7. The folder and removable reading light of claim 6 wherein the locking device is an outwardly biased detent.

8. The folder and reading light of claim 6 further comprising a circuit located in the casing for powering the reading light, the circuit containing a timer.

9. The folder and reading light of claim 6 further comprising a separable fastener located on an outer surface of the outer cover, a mating fastener engaged to a device or holder for mounting on the book cover.

10. The folder and reading light of claim 9 wherein the separable fastener is selected from the group consisting of adhesives, clips, magnetic, Velcro® or other separable fasteners.

* * * * *